US005405217A

United States Patent [19]

Dias et al.

[11] Patent Number: 5,405,217

[45] Date of Patent: Apr. 11, 1995

[54] DEVICE FOR EROSION CONTROL

[76] Inventors: Alain Dias, Ave Cote d'Argent, Marcheprime 33380; Marc Larcher, 11 Cours X. Arnozan, Bordeaux, both of France

[21] Appl. No.: 50,273

[22] PCT Filed: Nov. 12, 1991

[86] PCT No.: PCT/FR91/00887

§ 371 Date: May 7, 1993

§ 102(e) Date: May 7, 1993

[87] PCT Pub. No.: WO92/08848

PCT Pub. Date: May 29, 1992

[30] Foreign Application Priority Data

Nov. 12, 1990 [FR] France ..... 90 14008

[51] Int. Cl.[6] ..... E02B 3/06

[52] U.S. Cl. ..... 405/25; 405/15; 405/21; 405/258

[58] Field of Search ..... 405/21, 25–30, 405/15,16,258,263

[56] References Cited

U.S. PATENT DOCUMENTS

| | | | |
|---|---|---|---|
| 331,127 | 11/1885 | Goodridge | 405/21 |
| 954,283 | 4/1910 | Hawkes | 405/21 |
| 2,069,715 | 2/1937 | Arpin | 405/25 |
| 3,733,831 | 5/1973 | Stickey | 405/30 |
| 3,888,209 | 6/1974 | Boots | 405/25 X |
| 4,954,013 | 9/1990 | Lamberton | 405/25 |

FOREIGN PATENT DOCUMENTS

| | | | |
|---|---|---|---|
| 0051510 | 3/1988 | Japan | 405/21 |

*Primary Examiner*—Dennis L. Taylor

[57] ABSTRACT

An elongated tubular assembly comprising a plurality of tubular units disposed in end-to-end relationship, each unit comprising a lower section (1) composed of a variably rigid impermeable contact base (3), and an upper section (2) with a variably rigid protruding hull (5) designed to deviate surrounding fluid flows, the lower (1) and upper (2) parts being connected to each other at least along their longitudinal edges encompassing to such extent an internal space in which a ballast (15) can be admitted through registered hull openings (7), such flexible base and hull combination being designed to give stability to a light-weight version of said unit even in an environnment of heavy fluids, somewhat in the manner of a flat fish, for works including but not limited to ground erosion control and flood control.

9 Claims, 6 Drawing Sheets

DEVICE FOR EROSION CONTROL

Figure 1A:
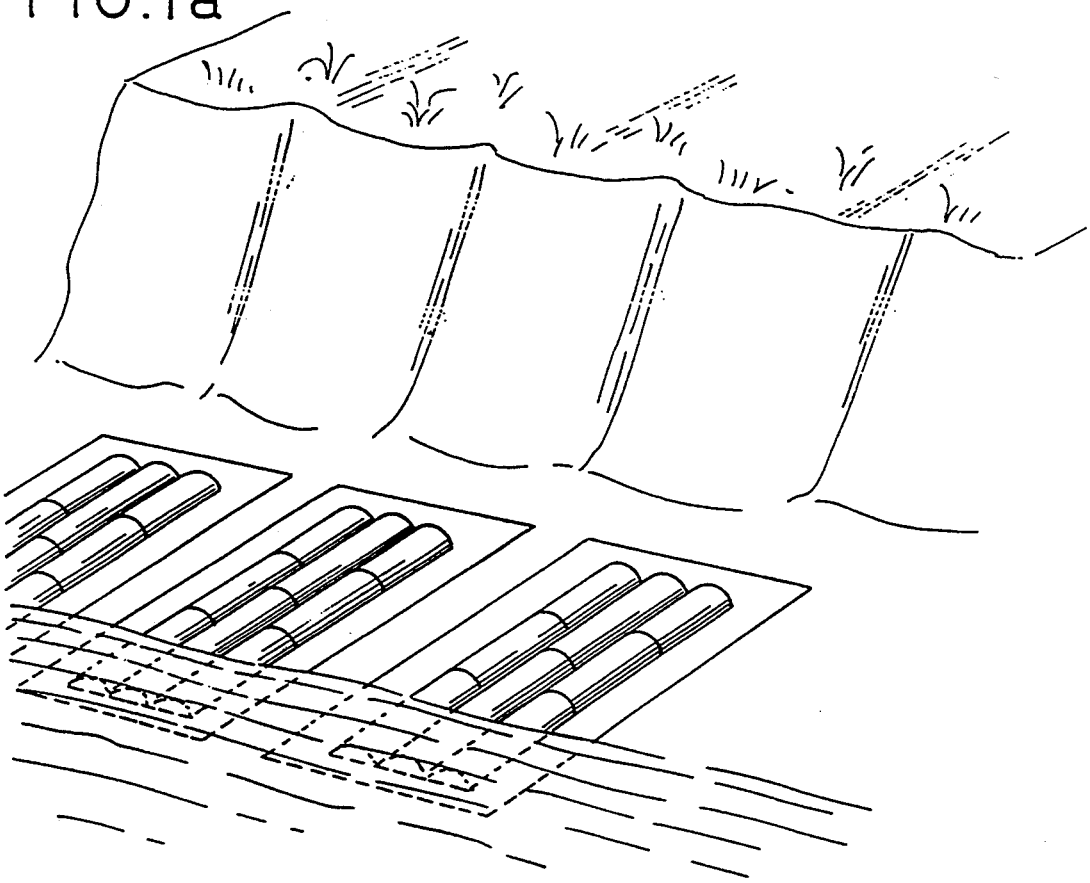
Figure 1B:
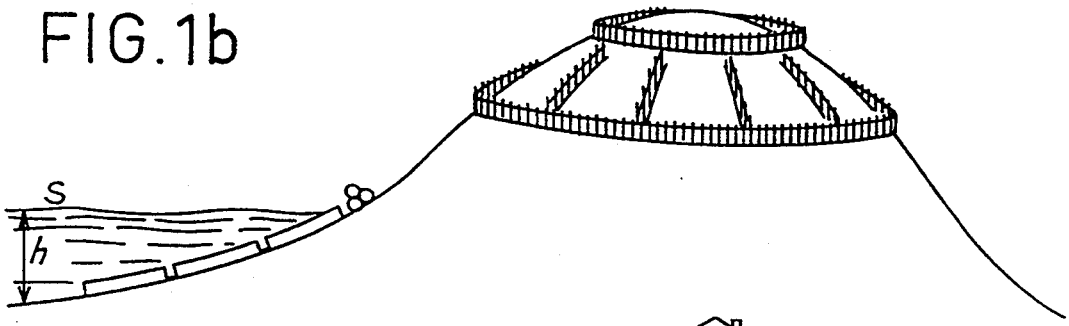
Figure 1C:
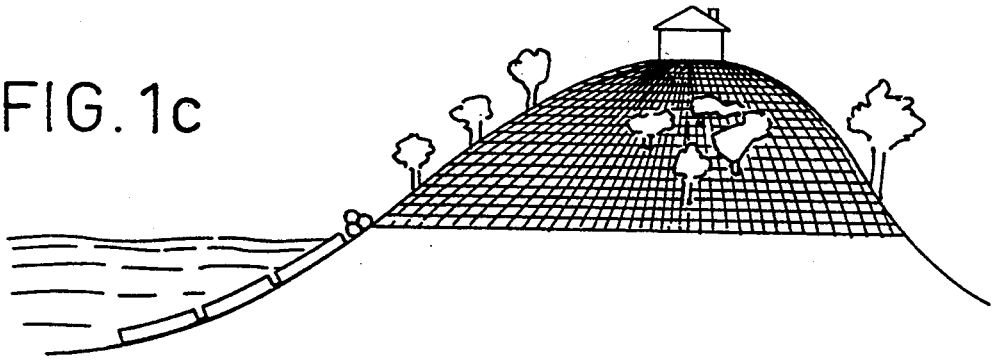
Figure 2A:
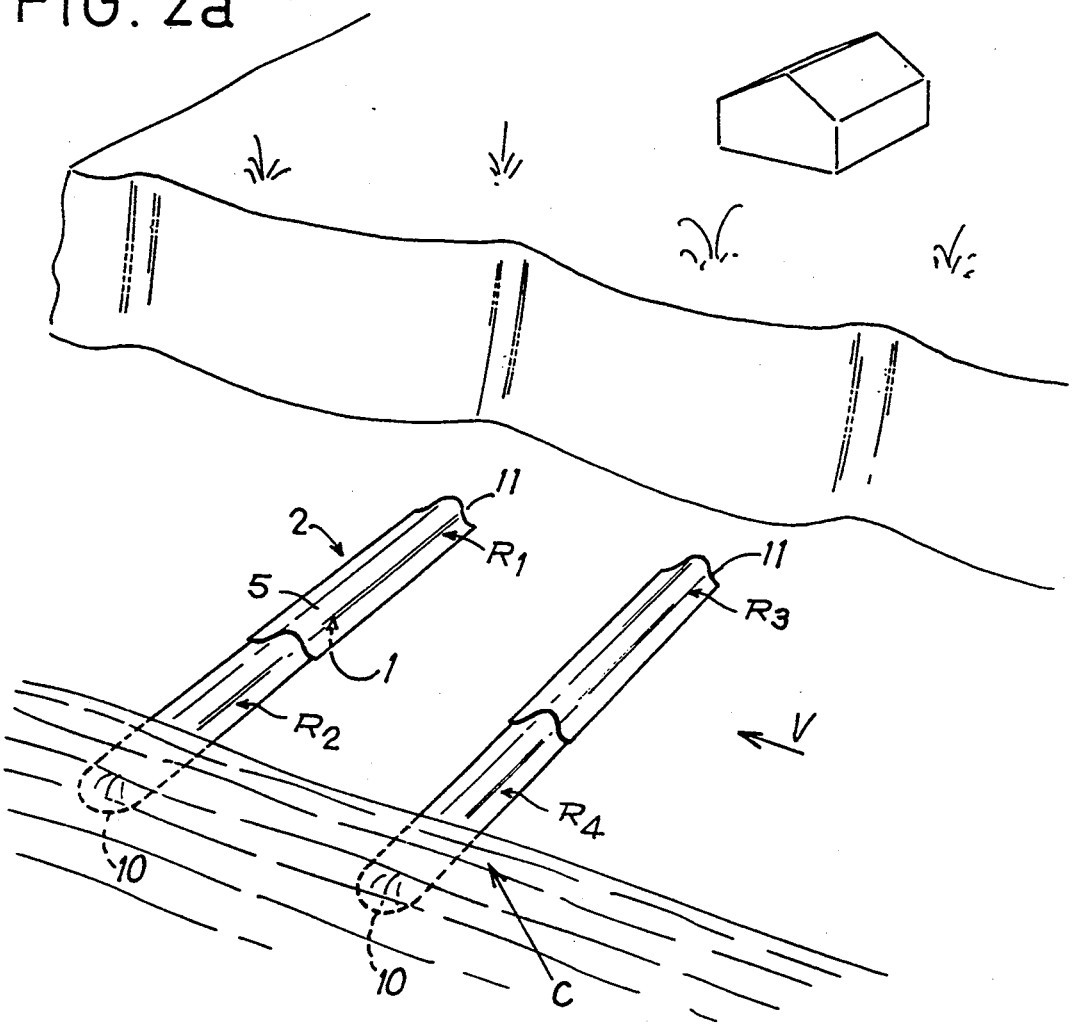
Figure 2B:
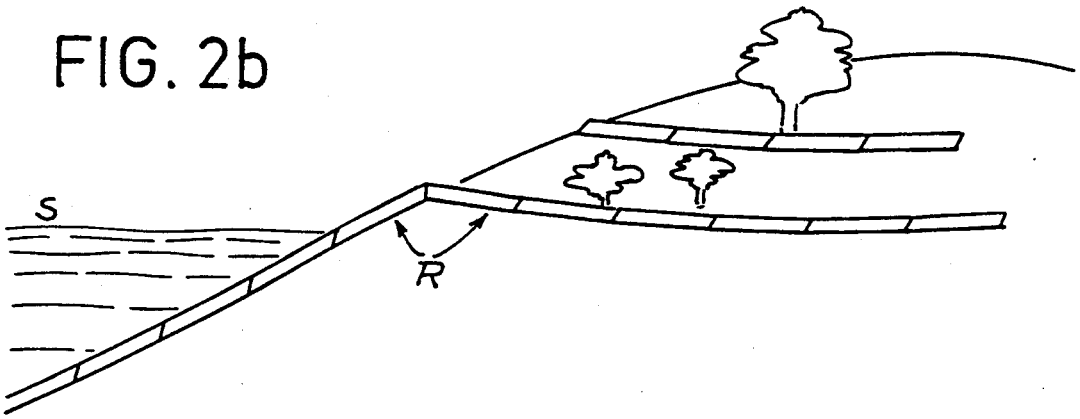
Figure 3A:
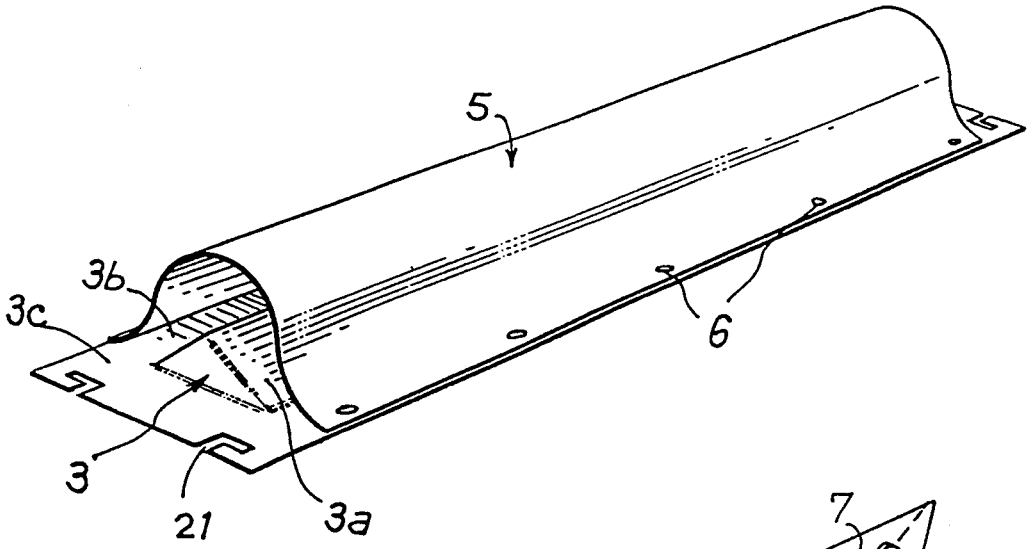
Figure 3B:
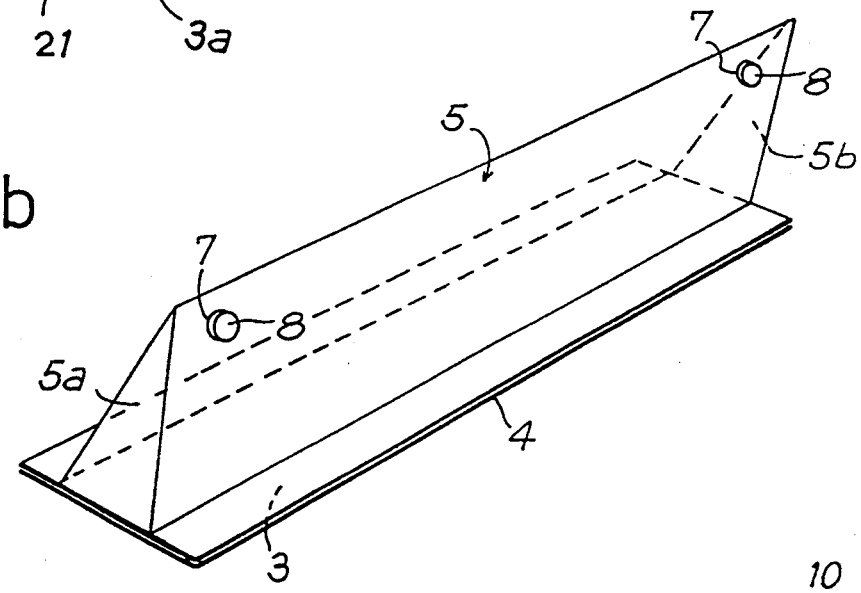
Figure 3C:
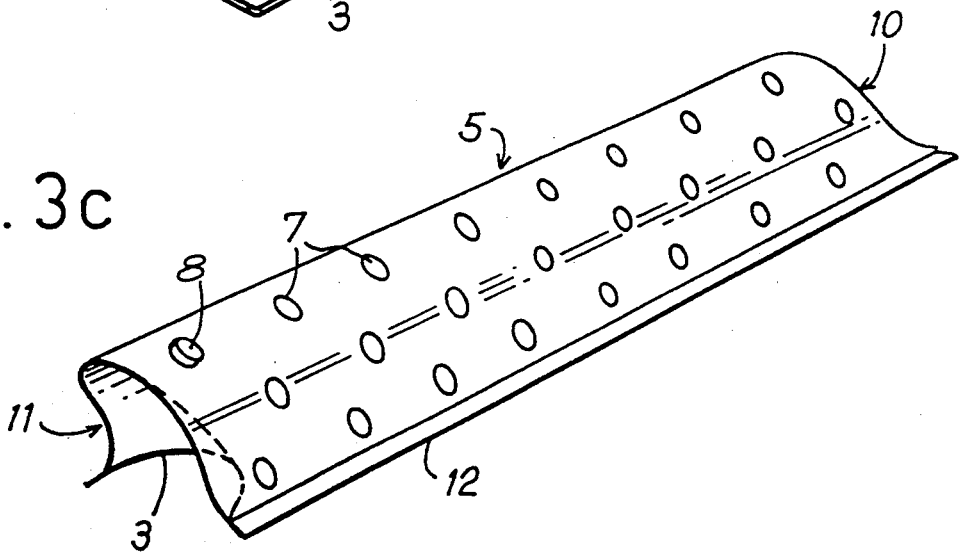
Figure 4A:
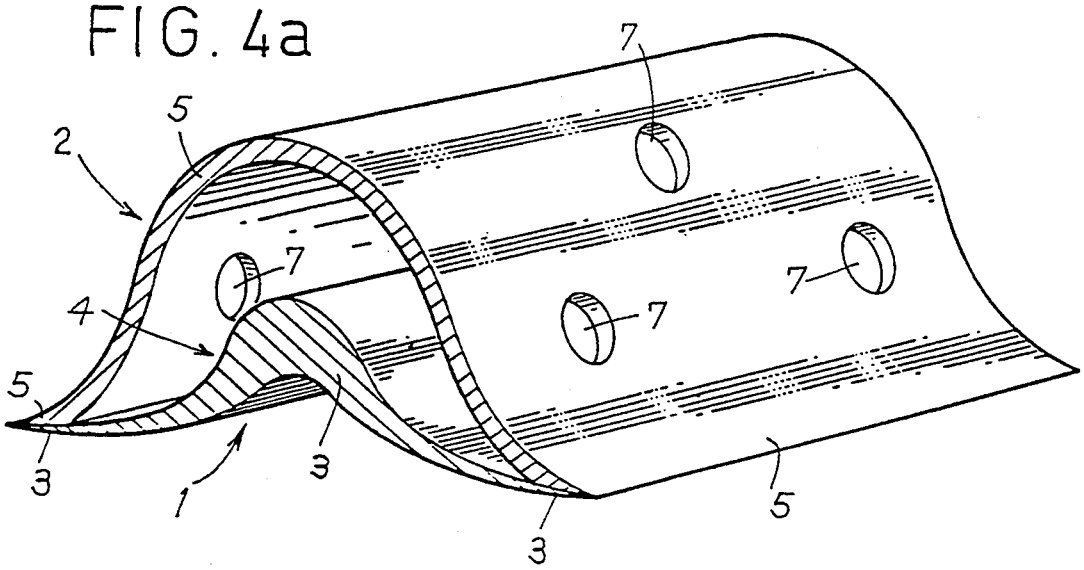
Figure 4B:
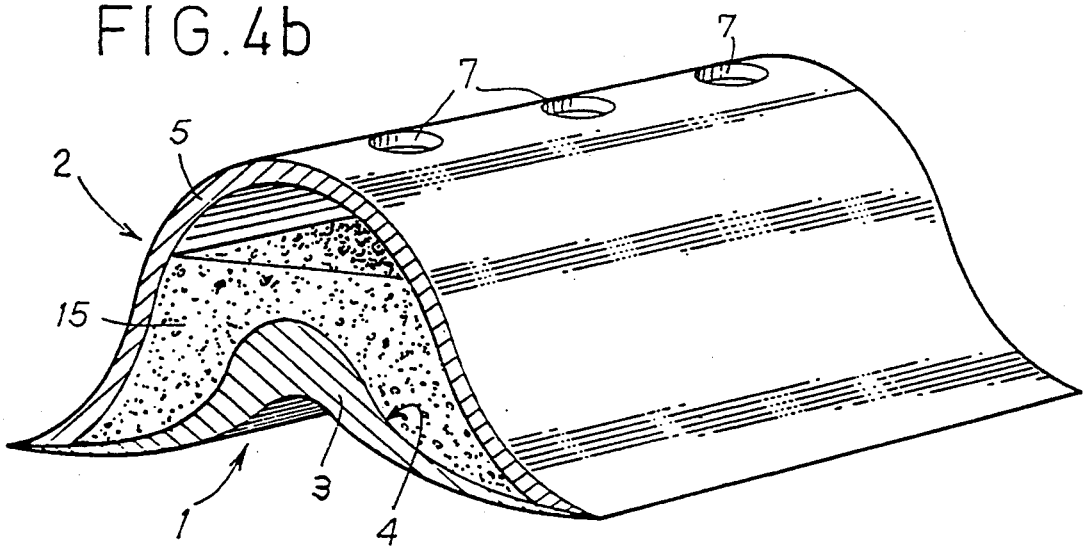
Figure 4C:
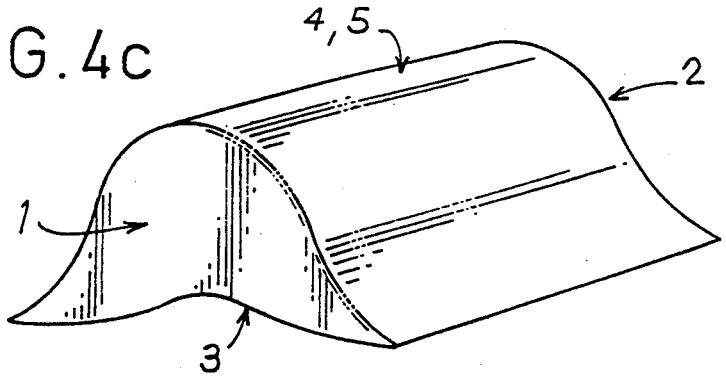
Figure 5:
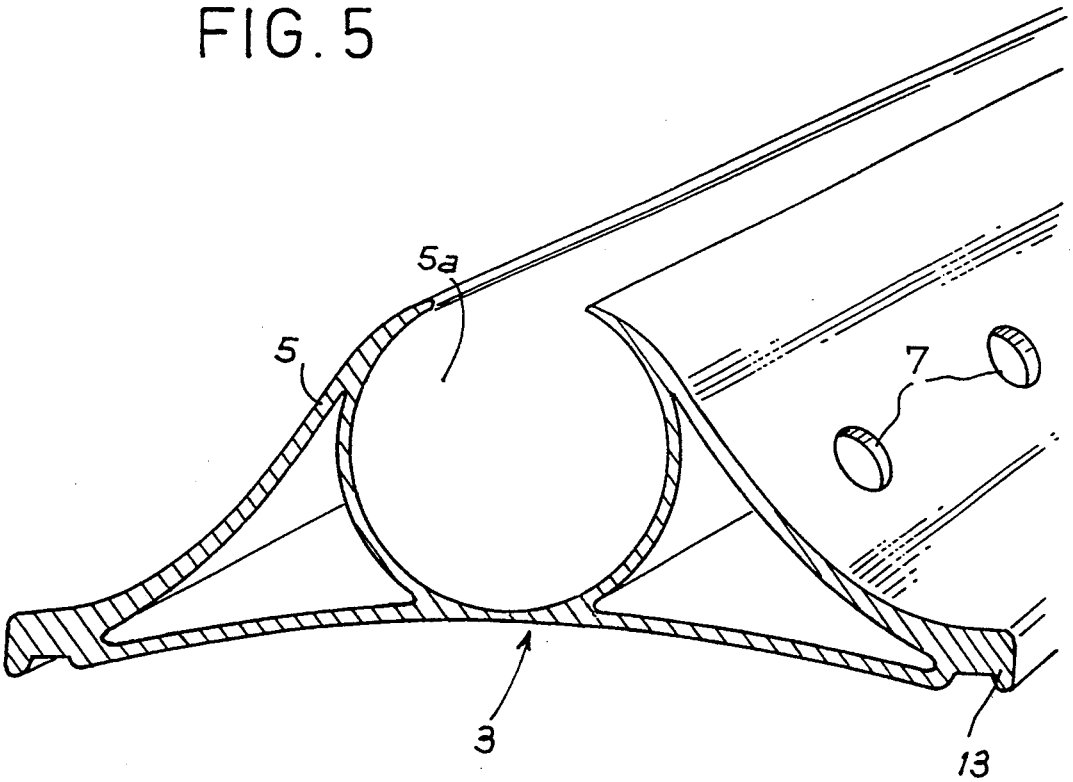
Figure 6:
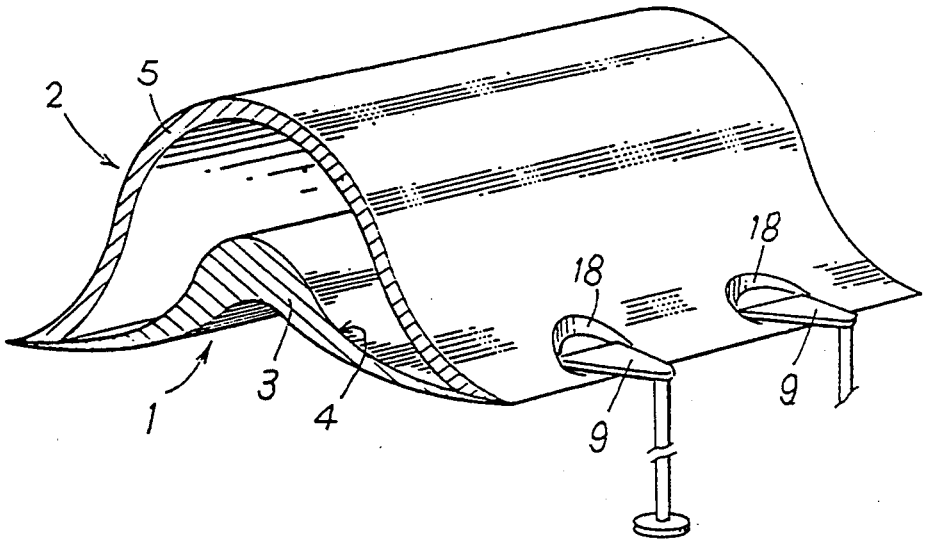
Figure 7:
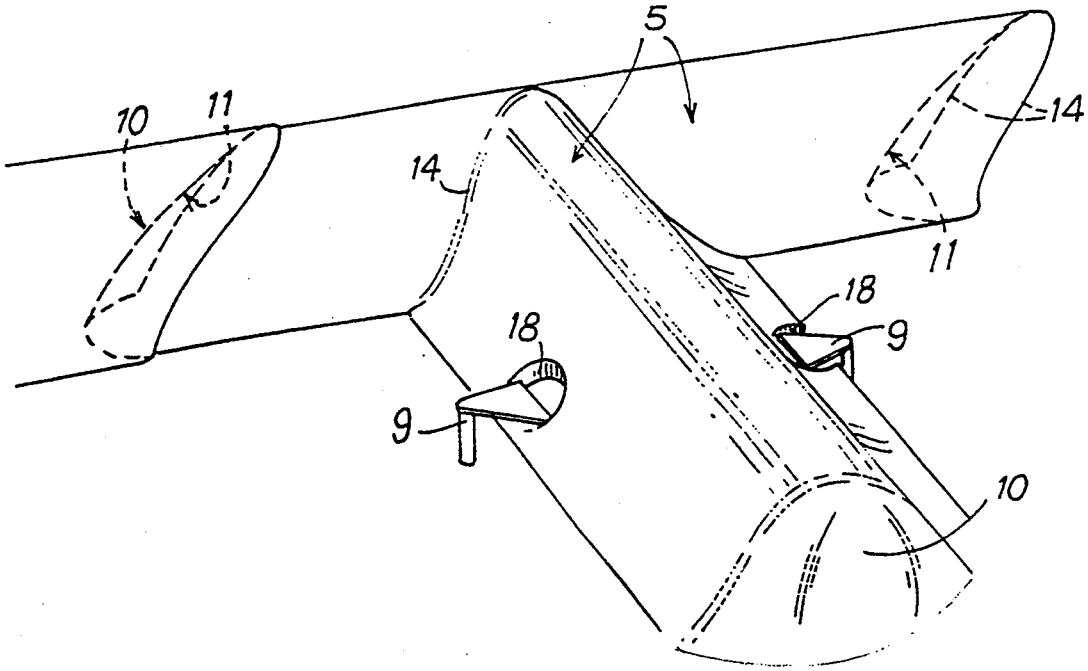

The invention described herein concerns a protruding hollow foundationless springy elongated modular device for the control of soil erosion and soil migration in a fluid environment. An economy of weight is achieved through the combination of a flatfish type variably rigid contact base and a streamlined hull. The invention also relates to the placing of units in end-to-end and/or perpendicular relationship to serve not only for the above purpose but also for other purposes such as flood, mud, aquaculture or other dams, and for the protection of vulnerable objects such as cables and utility lines in an active fluid environment.

The major purpose of the erosion-control device is the fixation of submersed sedimentary counterforts and dunes either by controlling the speed of the erosion fluid or by opposing a stationary implant to the migration of natural sedimentary ripples, thus provoking their increase in size and their fixation.

Surrounding fluids (air and water) cause soil erosion, in a general manner, in maritime and land environments, because of the speed of erosion which can be reached either by nature or following human intervention.

A device slowing down a maritime- or river-current can be compared with the artificial reproduction of a sedimentation ripple (mega-ripple) which forces the current upwards from the soil and thus favors the settling and concentration of the shifted mobile elements into new, natural sedimentation ripples simulating the profile of a delta or estuary thereby regenerating mobile shores.

Traditionally such a sedimentary action has been sought as a marginal function of oversized heavy shore constructions. Even when not oversized, the energy-reducing devices are made, more often than not, by filling envelopes of supple fabric used in earth works (bags, rollers, etc.) with such heavy ballast as sand or concrete which ensures stability and their unfolding on their own. When weighted in such a manner, the devices assume the shape of an extended semi-cylindrical wing and tend gradually to submerge in the sand under their own weight. Other technologies are employed to prevent this gradual submerging which, as in U.S. Pat. No. 4,690,585, (Holmberg) consist in laying the erosion control system on a porous apron of fabric used in earth works, anchored to the soil with peripheral pockets (drawing 1*a*).

Should these convex, relatively rigid, erosion slowing-down devices be fixed to a flexible and porous apron, the hydrostatic overpressure exerted on the wing is carried almost entirely through the apron to the soil below the structure which can cause it to lift and capsize. In addition, such devices can be laid only when loaded: they are heavy, susceptible to damage, occupy much space, are unpleasant in appearance and immovable. When made in long sections, they are prone to longitudinal fragility and can be broken by changes occuring in the soil.

One of the characteristics of the present invention lies in the possibility of assembling movable light-weight low-profile sedimentation structures in water. It may also prove imperative to change the location and/or orientation of these devices to obtain a better reproduction effect, taking into account the features of the maritime factors occuring within the operational zone.

On emerged land, light-weight supple devices, adapted to the aerial fluid constraints, are used to fix dunes behind protective wind breakers by the use of fabric netting spread on the ground (drawing 1*c*) or set vertically (drawing 1).

One of the purposes of the invention described herein is to fix submarine dunes using a light easy-to-install device adapted to the maritime fluid and to remedy the heavy or massive structures' faults or at least to limit them satisfactorily, while allowing better control of soil erosion using a simple and multi-functional device (maritime, river or land).

This purpose is met in the invention by laying the device, the lower section of which has elements to fix the device to the soil while the upper section has parts reducing the energy of erosion fluids—these parts comprising a variably rigid hull, while the fixing elements comprise a variably rigid non-permeable base the underside of which is subjected to a first hydrostatic pressure lower than the hydrostatic pressure acting upon the upper side of the above-mentioned fixing elements and resulting from the pressing force of the erosion fluids acting upon the hull. In addition, the top and bottom parts are rigidly connected at least on the edges, thereby forming an internal space which may be, at least partly, filled with ballast or with the elastic material of which the fixing elements and/or the energy-reducing elements may be made, it being posible that this elastic material make a solid piece with the above-mentioned elements.

In a first embodiment, the upper and lower parts are connected in a separable way.

In a second embodiment, the device is hollow and made up of a single piece.

In yet another embodiment, the device is solid and made up of a single elastic piece.

A merit worth highlighting is that the ends and edges of the hull have modular connecting elements allowing connection with similar devices of the same type to form a continuous unit. These elements comprise a male profile dovetailing with a female profile to create a longitudinal section and/or comprise a profile with side-adjusting walls, adjusting at least in part and in a continuous manner to the upper part's side walls to form lateral sections.

Due to its impermeable base preventing submergence in the soil, such a device laid in a direction which crosses the direction of the erosive fluids is subjected to hydrostatic pressure which cannot be transmitted to the soil due to the impermeability of its base. That is why the system creates a pressure differential between the two surfaces of the base and is forced to the soil by a force which increases as the energy of the erosive agents increases.

Should this device be used on a sea coast, the effect of this slowing down is sedimentation. The modular device, laid in rows at right angles to the erosive current, slows down the current and causes the sediment to settle.

Should converging rows be laid towards a narrowing gullet, the modular device will accelerate the current, dissipate the sediment and hence result in controlled erosion.

Although the domain of the present invention extends naturally to the control of land erosion as well as marine erosion by slowing down erosion fluids, it will be better understood if illustrated by existing examples of its applications to marine or river erosion control.

The invention is illustrated by the following description with enclosed drawings:

drawings 1*a* to 1*c* present perspective views of conventional massive devices to slow down erosion;

drawings 2*a* and 2*b* present perspective views of the device described in this patent at various sites;

drawings 3*a* to 3*c* present perspective views of the various manners in which the device of this invention can be made;

drawings 4*a* to 4*c* present perspective views with partial cross-sections of various embodiements of this invention;

drawing 5 presents a perspective view of one particular embodiement of this invention;

drawing 6 presents a perspective view of the device described in this invention together with the anchoring elements;

drawing 7 presents a perspective view of an assembly of several devices according to the invention.

Drawings 1*a* to 1*c* illustrate the previous state of the art.

As shown in drawing 2*a*, the device (R) which is the subject of this invention to slow down erosion (current C, wind V) is connected in modules with other devices of the same type to obtain an assembly (R1,R2, . . . Rn) set in relation to the shore in one or more contiguous rows, partly submerged and causing the increase of maritime and eolian sediment action. Generally, the device (R) comprises a lower section (1) with anchoring elements and an upper section (2) with elements reducing the energy of erosive fluids. The energy-reducing elements comprise a protruding variably rigid hull (5).

As shown in drawing 2*b*, the device slowing down erosion which is the subject of this invention contains at least one module (R) comprising an impermeable base and a hull. It can be placed equally well on submerged or emerged land and optimum accretion effect is obtained when module (R) is at right angles to the direction of the erosive fluid prevailing in the given environment (current, tides, rain, water drainage, wind, etc.).

Drawing 3*a* shows the device manufactured in two parts, the upper section (2) being equipped with means to reduce the impact of erosive factors and manufactured as a rigid protruding hull (5) of parabolic profile with a convex summit and horizontal lateral edges. The upper section (2) is connected to the lower section (1) by a fixing arrangement (preferably dismountable) for instance bolts (6).

The lower section (1) contains means to fix it to the soil, made of an impermeable base facing the soil. The impermeable base (3) contains dihedral surfaces (3*a*) whose peak angle is greater than 100° for instance and whose lateral extension inside the hull (5) forms a horizontal strip (3*b*) and whose longitudinal extension forms a peripheral skirt (3*c*) outside the hull (5), which mitigates erosion related to disturbances at the ends of the hull and can be used to link up with another module or to a soil anchor, thanks to the slots in which appropriate fixing items could be placed (belts, etc.). The ends of the device create an opening between base (3) and hull (5).

Drawing 3*b* shows a device comprising a flat impermeable base (3) and a closed hull (5) whose lateral walls form a dihedral plane inclined on each side of the peak edge prolonged by flattened lateral edges. The ends (5*a*, 5*b*) are respectively made as male and female parts, to allow the linking of the individual modules. The angle of the dihedral plane is selected at around 90°, for example, to enforce the erosive agent's ascending motion which causes it to slow down. Openings (7) can be made in the hull equipped with plugs (8) to introduce ballast which may be an absorbant sponge such as is used for liquid storage.

Drawing 3*c* shows a module of the invention device which has a parabolic hull and flattened lateral edges. Openings (7) are made in the hull (5) to permit filling with ballast, it being possible to equip them with plugs or one-way valves (8) to close them from the inside. The impermeable base (3) is fitted with a peripheral skirt (12) at least on its longitudinal edges, this being dug into the soil to a depth sufficient to hinder the lateral dissemination of the pressure of the erosive fluids under the device. The ends (10 and 11) are made respectively with a convex male and concave female profile, so that two modules of the same kind can be connected in a manner at least partly articulated to form a continuous longitudinal unit.

Among others, a prototype of the following overall dimensions was manufactured:

| | |
|---|---|
| length | 60 cm |
| width | 9 cm |
| rigid, convex, impermeable base | 5 mm |
| height with parabolic profil | 6 cm above |
| soil | |

Upper section set on lower section, but not fastened.

Mean current speed in the sand-carrying environment (river) 7.5 km/hr.

A total sand accretion (covering the entire device) has been obtained within 1 hour.

On drawing 4*a* the wall of base (3), of roughly parabolic shape, may be thicker in its middle than on the edges to gain variable longitudinal rigidity and more rapid flexing deformation on the edges which causes greater contact of the device with the light, running soil under the base surface. Openings (7) allow circulation of the erosive fluid and sedimentation within the space inside the device.

Drawing 4*b* shows a device in which the internal space between the lower section (1) and upper section (2) is partly filled with granular ballast (15), with openings (7) made near the peak of the hull (5), thereby allowing a gradual improvement in the device's stability.

Drawing 4*c* shows a single-piece device which may be hollow or solid and comprises upper section (2) and lower section (1).

In this case the interior is filled with the same elastic material as makes up the fixing and energy-reducing elements which are the base (3) and hull (5) respectively.

Once a device has been laid, the underside of the impermeable base (3) is subjected to a hydrostatic pressure lower than the hydrostatic pressure caused by the erosive fluids acting on the upper side of the base (3) and/or the hull (5). The slight oscillations of the variably rigid impermeable base suck the underlying sand into contact with the concave underside of the underlying base and/or with the grooved underlying base.

Drawing 5 illustrates an advantageous embodiement comprising, in particular, the impermeable base (3) and hull (5) with lengthwise slot (5*a*) permitting the rapid entry of the ballast, or of erosive fluids and natural sediment, or of a classical energy-reducing unit of earthworks fabric material or of a pipe-line.

Drawing 6 shows how a device can be made with blind seats (18) in the side wall of the hull (5) lower section and encroaching on the peripheral edges. These seats (18) are to hold the anchoring elements (9) which are fitted and adapted to protrude beyond the peripheral edge and to dig into the soil. They may also serve for handling the module.

Drawing 7 in conjunction with drawing 3c shows how modular devices described in the invention can be linked in two directions. The female end (11) possesses side-walls (14) formed by the extensions of hull (5), which adjust perpendicularly to the side walls of hull (5) of a module of the same type, to form a more or less continuous lateral chain. The male end (10) of convex and/or protruding profile dovetails with the female end (11) of concave or recessed profile.

Generally speaking, and with respect to all the drawings, it must be stressed that the device, once it is set on the soil or dug into the soil, cannot be moved vertically or laterally by the action of the erosive fluids nor can it float due to lower section (1) which is equipped with elements to fix it to the soil comprising the base (3), assisted if required by anchoring elements (6) or some ballast (15), depending on the extracting forces. The device is additionally secured in place by all weighing-down agents or anchors depending on the respective densities of the device and the erosive fluid as well as the energy of this fluid in the operation zone which may be reduced to their minimum by the lack of archimedes force under the device.

A first hydrostatic pressure acts on the underside of base (3) lower than the hydrostatic pressure of the erosive fluid due to the impermeability of the base surface which may for instance be laterally supplemented with a waterproof skirt (12) sunk into the soil.

When the erosive fluid (for example rain, sea current, tides or wind) increases its erosive speed, the impermeability of the base hinders this pressing force from being transmitted to the soil below the device and the variably rigid base and hull enhance the hydrostatic pressure differential by their suction cup effect as compared to that exerted on and/or inside the hull by erosion fluids.

The surfaces represented by base (3) and hull (5) thus act as a suction cup which forces the device against the soil and the soil under the device.

Base (3) hull and skirt (12) are best made of impermeable elastomer and the adherence to the soil can be increased by etching the underside of the base similarly to a tire pattern.

The device can be made a single-piece unit by rotational molding of polyethylene. Cement or ferrocement are also satisfactory materials when coating a springy structure.

The device according to the invention is made to withstand the extracting force of the erosive fluids which can reach 12 tons per square meter on the shores and 100 kilograms per square meter in the case of eolian erosion.

The device can also be used to direct the wind away from a dune being eroded or to slow down the flow of water in open-cast mines causing, respectively, an increase in the dune's height and the lifting and reinforcement of the earth.

One advantageous embodiement of the concave underside of the base allows the large concave variably rigid arch to flex and adhere to the ground and opposes slipping or tearing forces. In the early installation phase, anchoring appliances and ballast inherent to the invention allow a firm grasp of the device in the soil.

In an advantageous embodiment, the peripheral edges of hull (5) are at a tangent to the horizontal, or with a convex drape, thus allowing the dug-in device to better oppose extraction by the erosive fluids.

In another manner of embodiement, base (3) is made of a strong, impermeable cloth which is flat when at rest and will become concave when at work.

In order to impart an ascending motion to the erosive fluids, the hull (5) should protrude for instance with a parabolic, semi-cylindrical or dihedral shape and possess horizontal peripheral edges or edges dug into the soil.

When advantageously implemented, the relation of width to height should preferably be greater than 1.5 so that the base surface could have a width of 3 times its height for instance and length between 1.5 and 6 times its width for example.

The openings (7) can have a cross-section of from several square centimeters to several square decimeters, of uniform, preferably oval shape to allow them to be covered over from the inside. Due to its low weight, the device can be used on channel slopes and can be suspended on any kind of anchoring appliance fixed to sockets (18) or in slots (21).

In cases where the upper section and the lower section do not constitute a single piece, they are to be linked by bolts or any other means reconcilable with the chemical and mechanical properties of the material.

We claim:

1. An elongated tubular assembly for the control of soil erosion or soil migration in a fluid environment, said elongated tubular assembly comprising; a plurality of tubular units disposed in end-to-end relationship, each unit having a lower section (1) and an upper section (2), said lower section (1) having longitudinal edges and composed of a variably rigid impermeable contact base (3), said upper section (2) having longitudinal edges and a variably rigid protruding hull (5) designed to deviate surrounding fluid flows, the lower section (1) and the upper section (2) being connected to each other at least along their longitudinal edges defining an internal space therebetween in which a ballast (15) can be admitted through registered hull openings (7) in said upper section, said variably rigid base and hull combination being designed to give stability to said unit even in an environment of heavy fluid flow to control soil erosion or soil migration.

2. An elongated tubular assembly according to claim 1, being made of a single solid variably rigid piece of material.

3. An elongated tubular assembly according to claim 1 characterized by the upper part (3) being connected in disassemblable manner with the lower part (2).

4. An elongated tubular assembly according to claim 1 characterized by the sides, ends and edges having dovetailing male and female shaped elements (1,5,10,11,14) and seats (18) and slots (21) allowing the anchoring, welding, fastening, transport, stacking and installation of a plurality of tubular units in longitudinal and lateral assemblies in one or more layers.

5. An elongated tubular assembly according to claim 1 which includes registering units to define a barrier, said registered hull openings (7) being on the side where a surrounding fluid must be contained.

6. An elongated tubular assembly according to claim 1, the variable rigidity of which is obtained by the base (3) having a generally concave underside.

7. An elongated tubular assembly according to claim 1, the variable rigidity of which is achieved by the base (3) wall having variations of thickness along its width.

8. An elongated tubular assembly according to claim 1 characterized by being hollow, and having a longitudinal slot along the hull (5).

9. An elongated tubular assembly according to claim 1 the lower section (2) and upper section (3) are made of a single piece with an enclosed structure.

* * * * *